US006908115B2

(12) United States Patent
Synder

(10) Patent No.: US 6,908,115 B2
(45) Date of Patent: Jun. 21, 2005

(54) COMBINED REGISTER OPENING COVER AND REGISTER BOOT FRAME

(75) Inventor: Darryl L. Synder, Canton, OH (US)

(73) Assignee: Snyder National Corporation, Canton, OH (US)

( * ) Notice: Subject to any disclaimer, the term of this patent is extended or adjusted under 35 U.S.C. 154(b) by 238 days.

(21) Appl. No.: 10/235,974

(22) Filed: Sep. 5, 2002

(65) Prior Publication Data

US 2003/0068972 A1 Apr. 10, 2003

Related U.S. Application Data

(60) Provisional application No. 60/317,883, filed on Sep. 7, 2001.

(51) Int. Cl.[7] ..... F16L 25/00

(52) U.S. Cl. ..... 285/27; 285/189; 285/424; 454/289; 454/330

(58) Field of Search ..... 454/289, 292, 454/330; 52/302.1; 285/24, 27, 189, 192, 424

(56) References Cited

U.S. PATENT DOCUMENTS

| | | | |
|---|---|---|---|
| 674,991 | A | 5/1901 | Williams |
| 1,274,996 | A | 8/1918 | Davis |
| 1,429,811 | A | 9/1922 | Tynan |
| 1,488,694 | A | 4/1924 | Marks |
| 1,911,851 | A | 5/1933 | Schultz |
| 2,080,726 | A | 5/1937 | Lowinger |
| 2,229,388 | A | 1/1941 | Postlewait |
| 2,743,660 | A | 5/1956 | Scherff |
| 3,232,205 | A | 2/1966 | Bumstead |
| 3,589,265 | A | 6/1971 | Hedrick |
| 4,502,368 | A | 3/1985 | Hempel |
| 4,773,197 | A | 9/1988 | Sullivan |
| 4,773,308 | A | 9/1988 | Allen, Jr. |
| 4,829,886 | A | 5/1989 | Battaglin |
| 5,180,331 | A | 1/1993 | Daw et al. |
| 5,266,091 | A | 11/1993 | McDonald |
| 5,503,181 | A | 4/1996 | Kennedy |
| 5,542,223 | A | 8/1996 | Inda et al. |
| 5,597,392 | A | 1/1997 | Hawkins et al. |
| 5,720,660 | A | 2/1998 | Benedetto et al. |
| 5,947,815 | A | 9/1999 | Danforth |
| 6,066,044 | A | 5/2000 | Orendorff |
| 6,461,235 | B2 | 10/2002 | Rutler et al. |

*Primary Examiner*—Harold Joyce
(74) *Attorney, Agent, or Firm*—Zollinger & Burleron Ltd.

(57) ABSTRACT

A register opening cover may be used to cover register openings until the register boot is installed in the register opening. During the installation of the register boot, the invention may be used to hold the register boot in place until the register boot is securely connected to the floor. After the register boot is installed, the cover forms an insulator around the register boot. One embodiment of the invention provides a register opening cover and register boot frame that can be configured to fit register boots of different sizes. Another embodiment of the invention provides a register opening cover that will support some of the weight of a worker who may step on the covered register opening.

18 Claims, 10 Drawing Sheets

COMBINED REGISTER OPENING COVER AND REGISTER BOOT FRAME

CROSS-REFERENCE TO RELATED APPLICATIONS

This application claims priority from U.S. Provisional Patent Application Ser. No. 60/317,883 filed Sep. 7, 2001; the disclosures of which are incorporated herein by reference.

BACKGROUND OF THE INVENTION

1. Technical Field

The present invention generally relates to the technical field of heating, ventilation, and air conditioning equipment. More particularly, the present invention relates to equipment for mounting ventilation ducts in heating, ventilation, and air conditioning systems. Specifically, the present invention relates to a register boot frame that is first used to cover the register openings in new construction and is then used to help install the register boots.

2. Background Information

Duct systems for ventilation systems include register boots where the ducts extend through register openings in floors. Floors are installed in new construction before the duct systems are installed. The register openings are also cut into the floors before the ventilation ducts are installed. In new house construction, the register openings allow debris to fall through the floor into the basement. Such falling debris is undesirable in generally but is especially undesirable when the new concrete floor is poured in the basement. Covers for the register openings are thus desired in the art.

Register openings also create a safety hazard because people can accidently step through the openings and injure a foot, an ankle, or a leg. Any cover provided for the register openings would ideally provide a warning to those walking near the openings and would support the weight of a person who accidently steps on the cover.

Another problem with register openings and register boots is that they are somewhat difficult and time consuming to install. The worker installing a register boot must first position the boot from below and have second worker connect the boot to the floor from above. This process is undesirable because it requires two workers. Another drawback is that the resulting connection between the register boot and the floor can be rather leaky.

BRIEF SUMMARY OF THE INVENTION

The present invention provides a register opening cover that may be used to cover register openings until the register boot is installed in the register opening. During the installation of the register boot, the invention may be used to hold the register boot in place until the register boot is securely connected to the floor. After the register boot is installed, the cover forms an insulator around the register boot.

One embodiment of the invention provides a register opening cover and register boot frame that can be configured to fit register boots of different sizes. Another embodiment of the invention provides a register opening cover that will support some of the weight of a worker who may step on the covered register opening.

BRIEF DESCRIPTION OF THE SEVERAL VIEWS OF THE DRAWINGS

Similar numbers refer to similar elements throughout the specification.

DETAILED DESCRIPTION OF THE INVENTION

Figure 1:
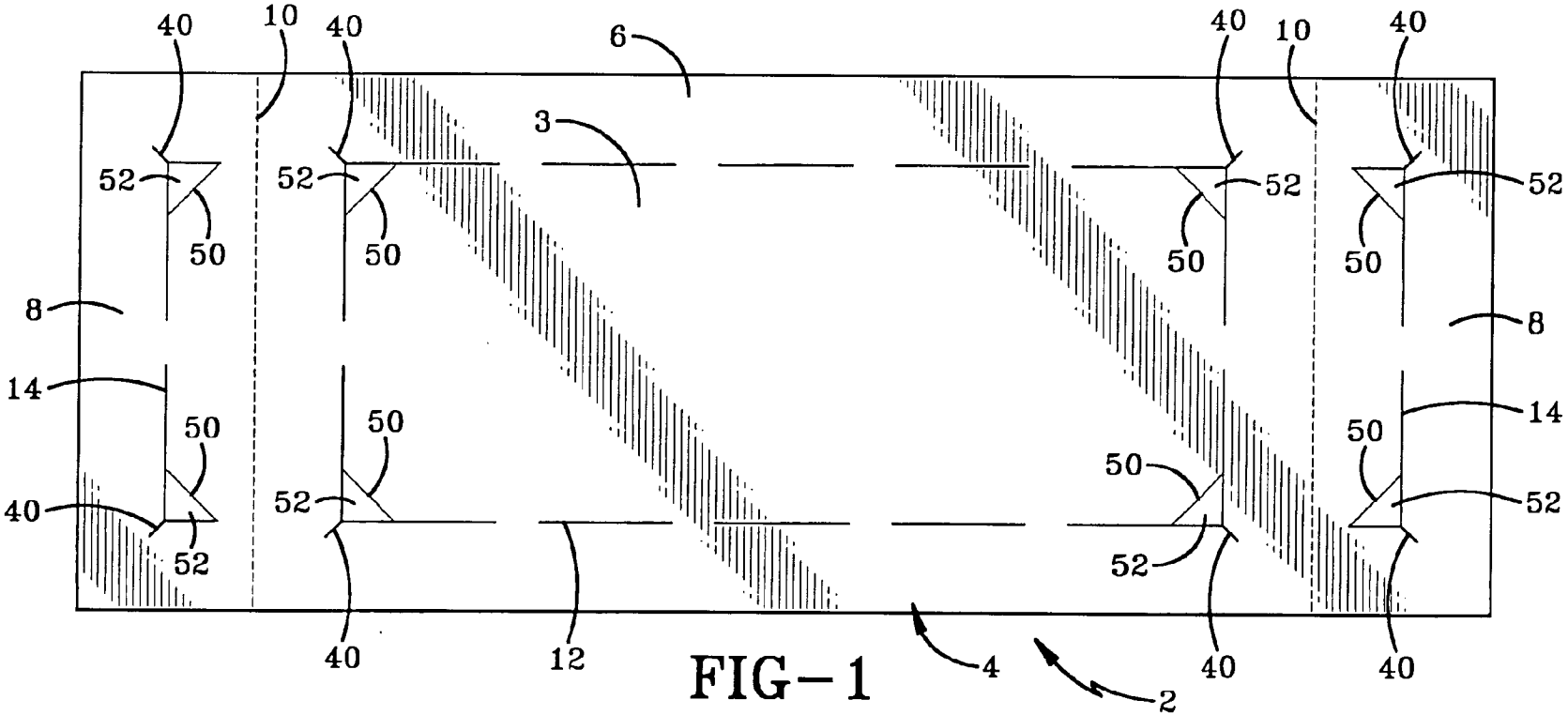
FIG. 1 is a top plan view of the first embodiment of the register boot frame of the present invention.
Figure 2:
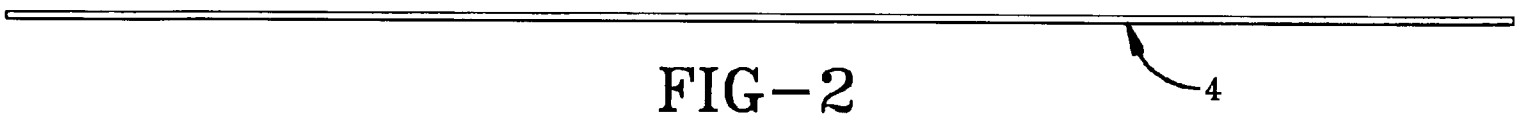
FIG. 2 is a side view of the frame of FIG. 1.

The first embodiment of the register boot frame of the invention is indicated generally by the numeral 2 in the accompanying drawings. Frame 2 may be configured to be used with ten, twelve, or fourteen inch register boots by selectively removing the middle portion 3 of the body 4 of frame 2. In the first embodiment, body 4 includes a center portion 6 and two end portions 8 that are separated from center portion 6 with a perforation line 10. Perforation lines 10 allows both end portions 8 to be removed to size frame 2 to fit the ten inch register boot. One end portion 8 may be removed to size frame 2 to fit the twelve inch register boot. When a fourteen inch register boot is used, both end portions 8 remain in place. In another embodiment of the invention, markings are used instead of perforation lines 10 and the worker cuts end portions 8 away with a knife or scissors.

Center portion 6 of frame 2 defines noncontinuous slits 12 in the form of a ten inch rectangle. Slits 12 are noncontinuous so that middle portion 3 does not fall out of center portion 6 until the worker intends to remove it. Noncontinuous slits 12 also allow middle portion 3 to support weight when frame 2 is initially installed. This allows frame 2 to support a worker who accidently steps on frame 2 when it is installed over a register opening.

Figure 4:
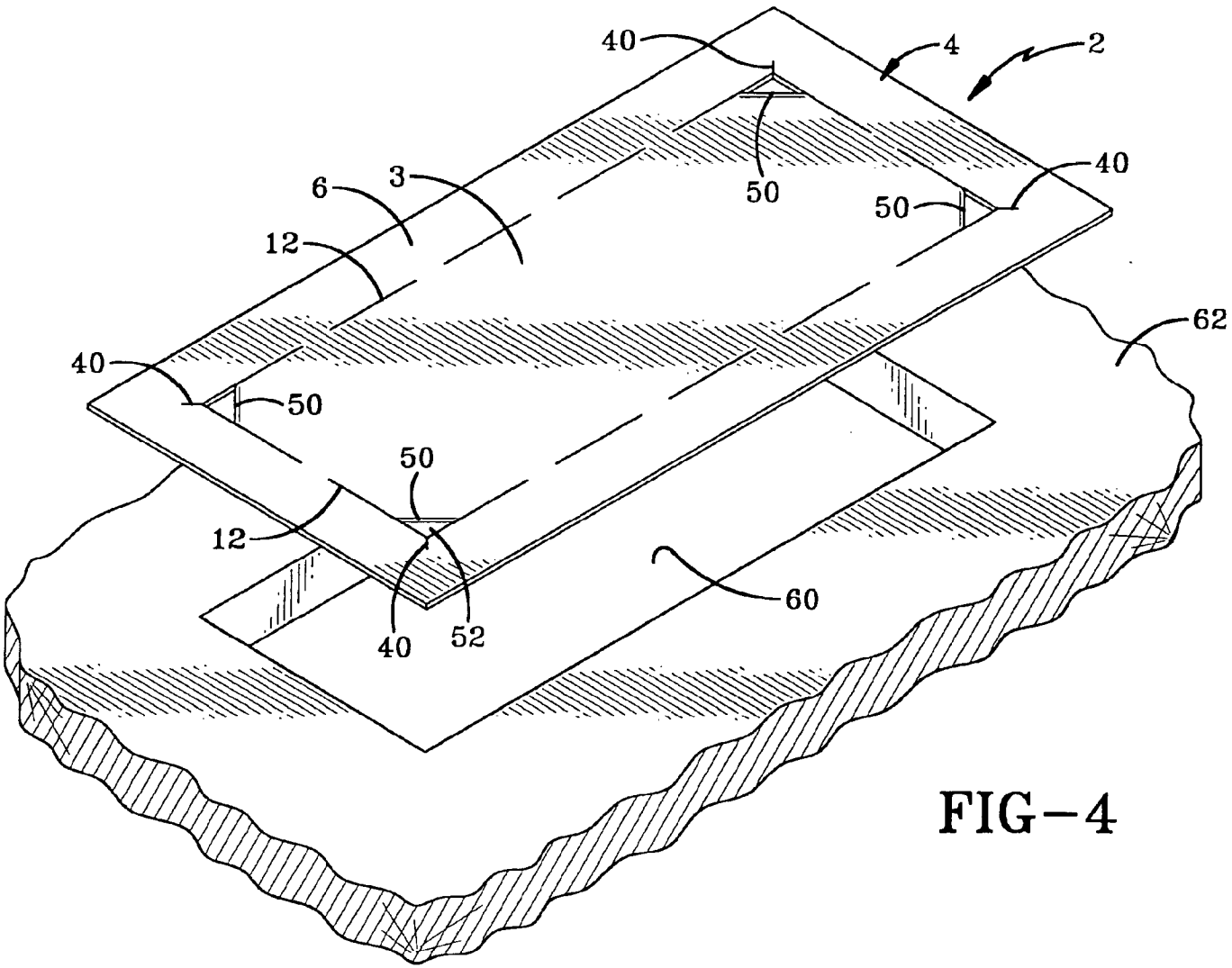
FIG. 4 is a perspective view of a floor section having a register opening with the register boot frame of the invention aligned with the opening before it is installed.

When frame 2 will be used with a ten inch register boot, the worker removes both end portions 8 and cuts away middle portion 3 with a suitable knife. This configuration is depicted in FIG. 4. In another embodiment of the invention, the ten inch rectangle may be marked on center portion 6 and the worker would cut out middle portion 3 with a knife.

Each end portion 8 defines a noncontinuous, C-shaped slit 14 positioned with the open end of the C facing center portion 6. When frame 2 is used with a twelve inch register boot, one C-shaped slit 14 is cut away such that the overall opening in frame 2 is twelve inches. In the twelve inch configuration, only one end portion 8 is cut away. When frame 2 is used with a fourteen inch register boot, two C-shaped slits 14 are cut away such that the overall opening in frame 2 is fourteen inches. In the fourteen inch configuration, both end portions 8 are used with frame 2.

Figure 3:
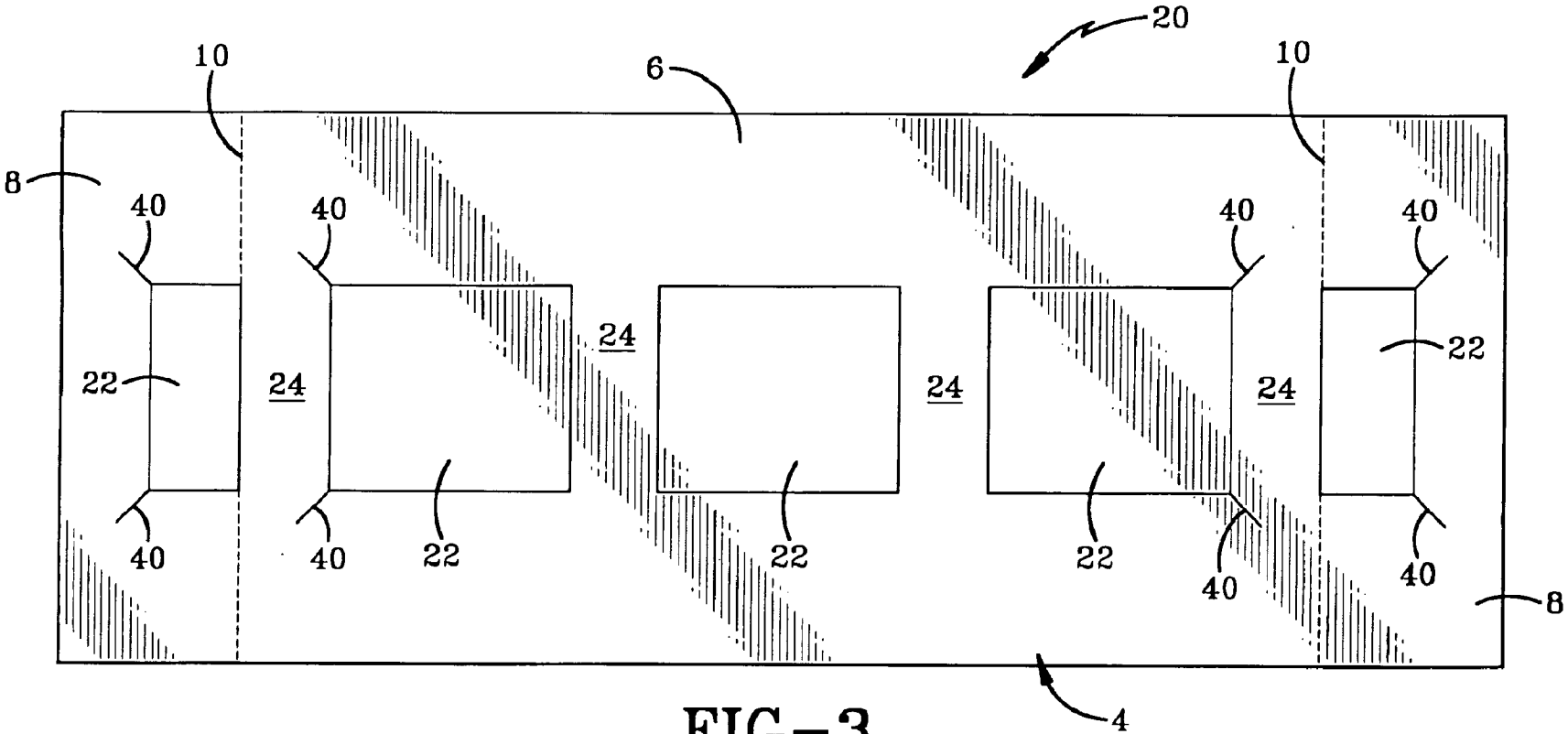
FIG. 3 is a top plan view of the second embodiment of the register boot frame of the present invention.

In the first embodiment of the invention, frame 2 is designed to be used with register boots that are four inches width and ten, twelve, or fourteen inches long. In the second embodiment of the invention, frame 20 (FIG. 3) is designed to work with register boots that are 2¼ inches wide. In the second embodiment, frame 22 includes a plurality of openings 22 separated by bars 24. Bars 24 are cut away in order to form the openings for the register boots. In this embodiment, bars 24 are used to support weight when frame 20 is initially installed. Frame 20 may also be configured with noncontinuous slits.

Figure 3A:
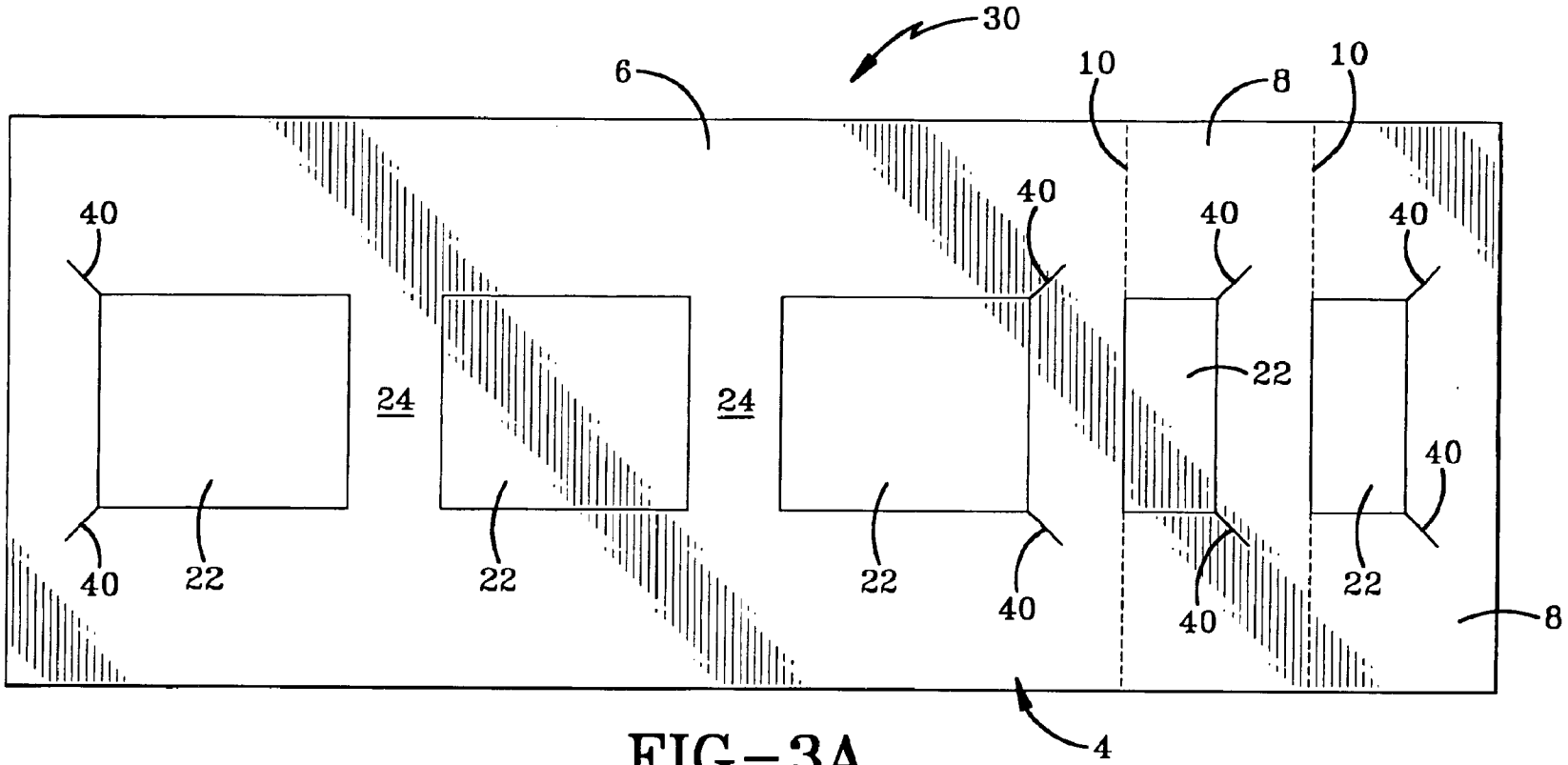
FIG. 3A is a top plan view of the third embodiment of the register boot frame of the present invention.

A third embodiment of the invention is depicted in FIG. 3A and is indicated generally by the numeral 30. Frame 30 has two end portions 8 disposed at the same end of center portion 6. Frame 30 may include noncontinuous slits or the openings and bars depicted in the drawing.

Each of these embodiments may include corner slits 40 that allow the sidewalls of body 4 to flex when a register boot is forced up through the opening of body 4. As will be described below in more detail, the openings in body 4 is sized to frictionally engage the outer surface of the register boot. Corner slits 40 allow body 4 to frictionally engage the register boot without tearing.

Body 4 of each embodiment may be fabricated from a corrugated polymer material. The corrugations may be disposed to run across the width of frame 2 to increase the strength of the material. The corrugations may also run the length of frame 2. When the corrugations run along the longitudinal direction of frame 2, the longitudinal edge of frame 2 may be folded up as described below with respect to fold line 80. The material may be opaque and coloreci brightly to draw attention to the frame when it is initially positioned over a register opening. This material also allows some light to pass through into the lower level. Each frame may also be clearly marked with a warning that the frame is "NOT A STEP" so that workers will not fall through the frame and register opening.

Body 4 may also define corner fold lines 50 that allow the inner corners 52 to be folded down to help the worker position frame 2 with respect to the register opening.

Figure 5:
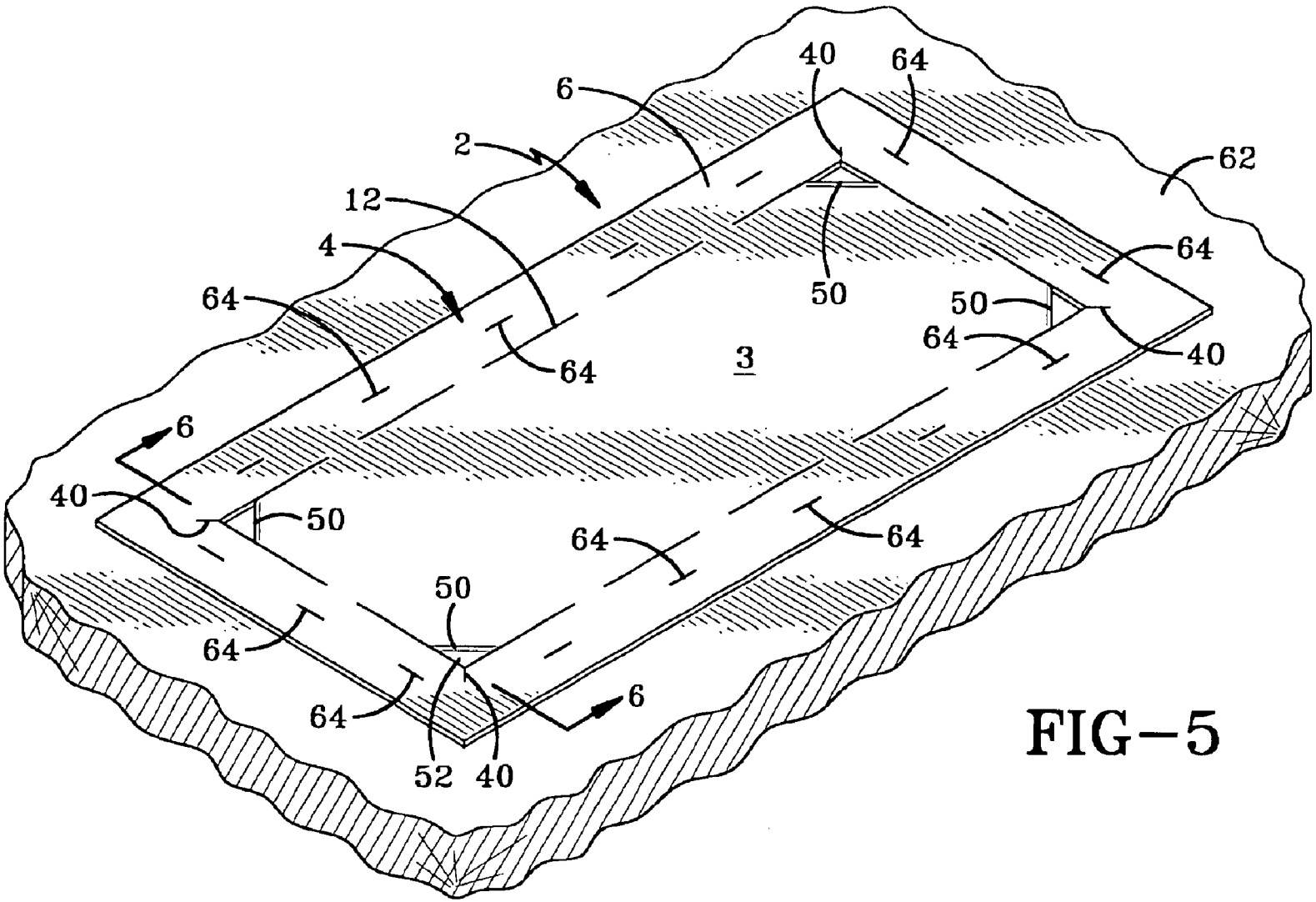
FIG. 5 is a view similar to FIG. 4 showing the register boot frame installed over the opening.
Figure 6:
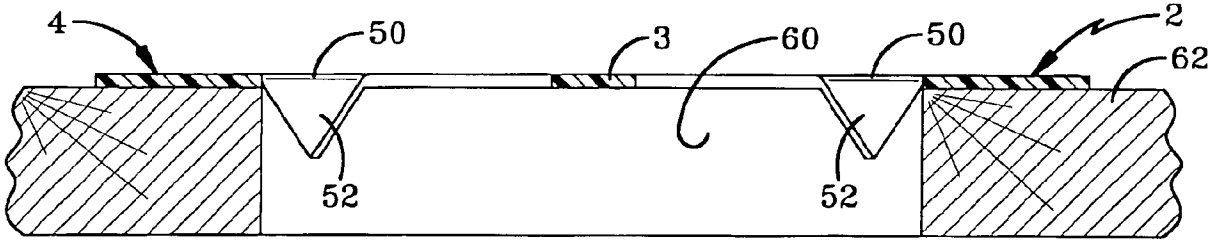
FIG. 6 is a section view taken along line 6—6 of FIG. 5.
Figure 7:
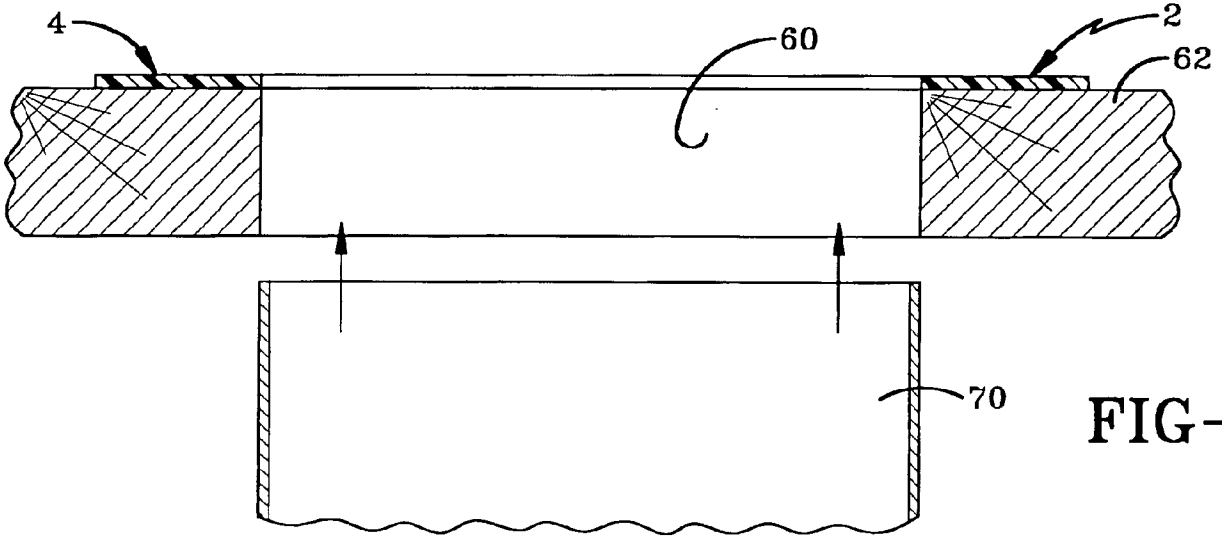
FIG. 7 is a view similar to FIG. 6 showing the register boot frame with the center section removed and a register boot being aligned with the register opening.
Figure 8:
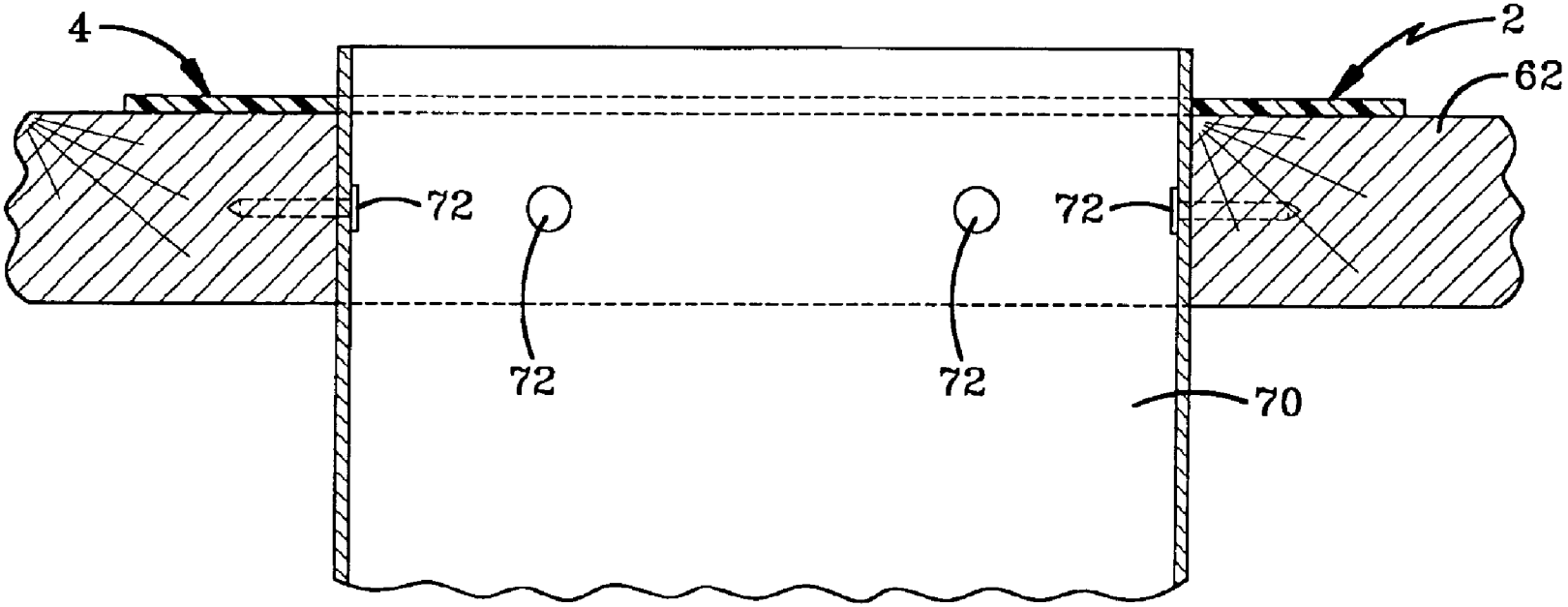
FIG. 8 is a view similar to FIG. 6 showing the register boot installed in the register opening.
Figure 9:
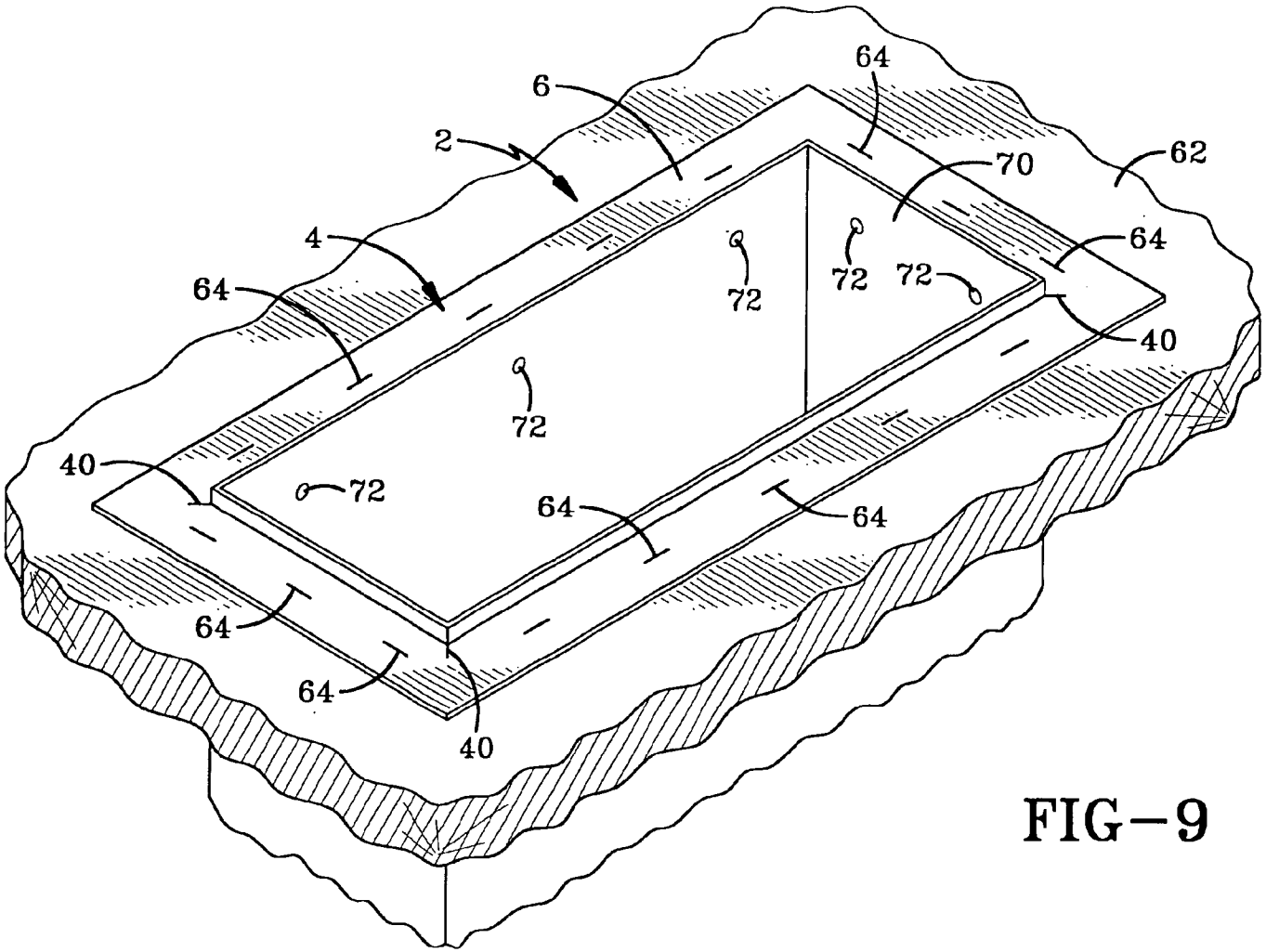
FIG. 9 is a perspective view of the register boot installed in the register opening with the register boot frame of the invention.

Frame 2 is used in the manner depicted in FIGS. 4–9. One frame 2 may be used as a template to mark opening 60 on floor 62. The width of frame 2 may be used to space opening 60 from the wall. The user then cuts floor 62 along the marked lines to form opening 60. An unused frame 2 is then selected to match opening 60. In the example, frame 2 is being used with a 10×4 inch opening 60. When inner corners 52 are not used, frame 2 is aligned with opening 60. If corners 52 are available, the worker may fold down inner corners 52 before placing frame 2 over opening 60. Inner corners 52 allow frame 2 to be easily positioned over opening 60 as depicted in FIGS. 5 and 6. Once positioned, frame 2 is connected to floor 62 with appropriate connectors 64 such as staples, screws, nails, or glue. Frame 2 then remains in place covering opening 60 for safety and preventing debris from falling though opening 60.

When register boot 70 is to be installed, the worker removes middle portion 3 and slides register boot 70 up through frame 2 from below. Frame 2 frictionally engages the outer surface of register boot 70 so that frame 2 will hold register boot 70 in place while the worker walks upstairs and connects register boot 70 to floor 62 with appropriate connectors 72. Duct tape may be used between frame 2 and boot 70 to prevent air from flowing between the two members. The invention thus allows a register boot to be installed by a single worker instead of the two workers in the past.

The flooring material may be positioned over frame 2 around the protruding portion of register boot 70. Frame 2 then functions to seal opening 60 and to provide some insulation properties.

Figure 10:
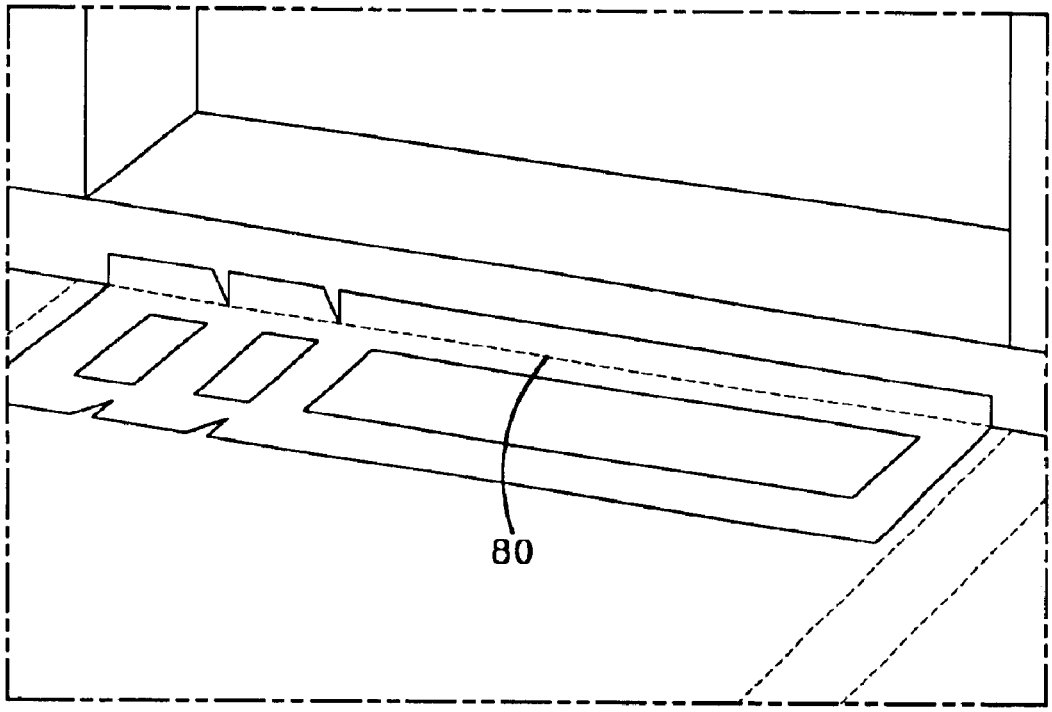
FIG. 10 is a perspective view of an alternative embodiment installed adjacent a wall with the longitudinal edge of the frame folded up.
Figure 11A:
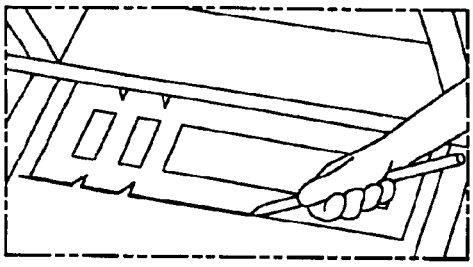
FIG. 11 is a series of views showing the installations processes for the invention.
Figure 11B:
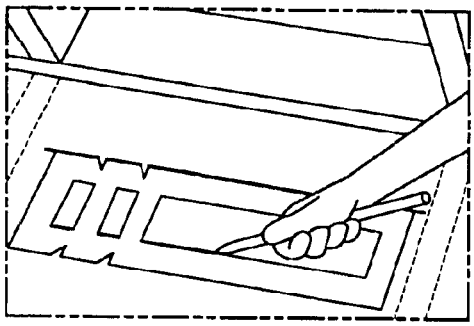
Figure 11C:
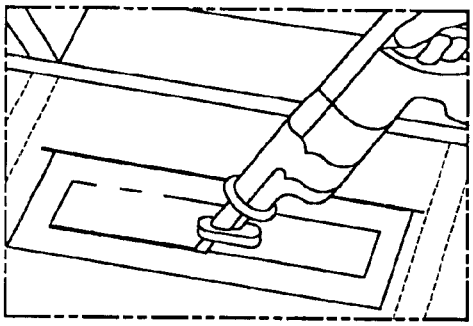
Figure 11D:
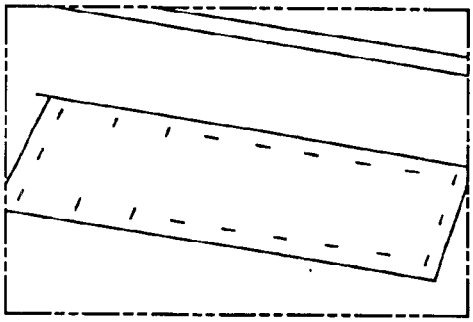
Figure 11E:
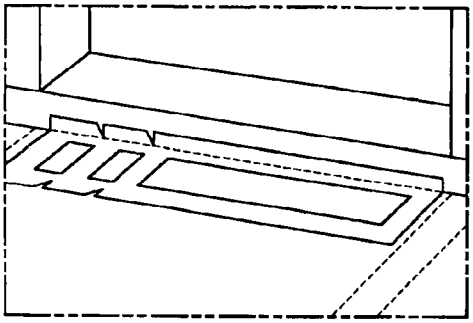

In alternative embodiments, frames 2, 20, or 30 may include a fold line 80 that allows one of the longitudinal edges of frame 2, 20, or 30 to be folded up to abut a wall adjacent opening 60 as shown in FIG. 10. Fold line 80 may be a mark that shows the user where to fold the frame. Fold line 80 may also be a perforated line or a score line that allows the user to easily make the fold. This configuration is designed specifically for a baseboard boot frame application.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A method of installing a register boot in a floor having an opening; the floor having an upper surface and a lower surface; the method comprising the steps of:

(a) positioning a first frame over a register opening in a floor and securing the position of the first frame with respect to the register opening;

(b) forming a first opening in the first frame; the first opening being aligned with the register opening;

(c) positioning a portion of a register boot through the first opening by moving the portion of the register boot upwardly from below the floor through the register opening until the portion of the register boot frictionally engages the first frame;

(d) supporting the register boot with the first frame; and (e) connecting the register boot to the floor after step (d) with fasteners.

2. The method of claim 1, further comprising the step of using a second frame as a template to mark the location of the register opening on the surface floor before the register opening is formed in the floor; the second frame having a width and a length; the second frame being identical to the first frame.

3. The method of claim 2, further comprising the step of using the width of the second frame to space the location of the register opening from a corner that defines an end wall of the floor.

4. The method of claim 2, further comprising the step of cutting the floor to form the register opening.

5. The method of claim 1, wherein the steps are performed by one person.

6. The method of claim 1, further comprising the steps of:

providing the first frame with inner corners;

folding the inner corners down to create folded inner corners;

positioning the folded inner corners in the register opening during step (a); and removing the folded inner corners from the first frame during step (b) when the first opening is formed in the first frame.

7. The method of claim 1, further comprising the step of taping the register boot to the first frame after step (e) to seal the register opening.

8. The method of claim 1, wherein the first frame has an edge and further comprising the step of folding the edge of the first frame upwardly during step (a).

9. The method of claim 1, further comprising the step of positioning flooring material over the first frame after step (e).

10. A combined register opening cover and register boot frame comprising:

a body having a center portion and two end portions; the two end portions being separated from the center portion with at least one cut line; the two end portions being aligned with the center portion;

each of the portions being defined by cut lines that mark locations for openings to be formed in the body; and the cut lines of the center portion being sized to form a first opening adapted to receive a first register boot; the cut lines of the center portion in combination with the cut lines of one of the end portions being sized to form a second opening adapted to receive a second register boot; the second opening being larger than the first opening; the cut lines of the center portion in combination with the cut lines of both end portions being sized to form a third opening adapted to receive a third register boot; and the third opening being larger than the second opening.

11. The cover of claim 10, wherein the at least one of the cut lines is a perforation in the body.

12. The cover of claim 10, wherein the body is fabricated from a corrugated polymer material.

13. The cover of claim 10, wherein the center portion is disposed between the end portions.

14. The cover of claim 10, wherein one end portion is disposed between the center portion and the other end portion.

15. The cover of claim 10, wherein the cut lines of the end portions are C-shaped.

16. The cover of claim 15, wherein the cut lines are aligned with each other.

17. The cover of claim 10, wherein the cut lines define corners and the body defines slits at the corners.

18. The cover of claim 10, wherein the cut lines define corners and the body defines corner fold lines disposed adjacent the corners.

* * * * *